US005505124A

United States Patent [19]

Esposito

[11] Patent Number: 5,505,124

[45] Date of Patent: Apr. 9, 1996

[54] PRINTING PRESS WITH A DEVICE FOR PROVIDING A SUCTION FORCE

[75] Inventor: Francesco Esposito, Dossenheim, Germany

[73] Assignee: Heidelberger Druckmaschinen Aktiengesellschaft, Heidelberg, Germany

[21] Appl. No.: 396,979

[22] Filed: Mar. 1, 1995

[30] Foreign Application Priority Data

Mar. 2, 1994 [DE] Germany ..... 44 06 739.9

[51] Int. Cl.[6] ..... B41F 7/02; B41F 1/32

[52] U.S. Cl. ..... 101/142; 101/389.1; 101/485

[58] Field of Search ..... 101/389.1, 232, 101/407.1, 474, 480, 485, 486, 216, 217, 218, 137, 142, 177; 269/21; 248/363; 271/194, 195, 94, 96, 197, 276; 198/689.1; 83/100

[56] References Cited

U.S. PATENT DOCUMENTS

| | | | |
|---|---|---|---|
| 3,415,478 | 12/1968 | Williams, III . | |
| 4,479,435 | 10/1984 | Takeuchi et al. . | |
| 4,646,911 | 3/1987 | Pearl et al. | 198/689.1 |
| 4,651,984 | 3/1987 | Emrich | 271/96 |
| 4,675,242 | 6/1987 | Hashimoto | 269/21 X |
| 4,730,526 | 3/1988 | Pearl et al. | 198/689.1 |
| 4,768,763 | 9/1988 | Gerber | 269/21 |
| 5,243,909 | 9/1993 | DeMoore | 271/194 X |
| 5,277,092 | 1/1994 | Kinta | 83/100 |
| 5,277,093 | 1/1994 | Kinta | 83/100 |
| 5,348,285 | 9/1994 | Huser | 271/197 |

FOREIGN PATENT DOCUMENTS 1802687 6/1969 Germany .

*Primary Examiner*—J. Reed Fisher

*Attorney, Agent, or Firm*—Nils H. Ljungman & Associates

[57] ABSTRACT

A printing press having a device for uniformly providing a suction force on a plane body on a support, the device comprising a closed suction chamber having a supporting surface, the supporting surface featuring suction ports. A blower, assigned to the suction chamber, produces an underpressure or vacuum pressure in the suction chamber. The device is designed so as to increase the suction capacity in the marginal area of the body to be sucked by using as little energy as possible, Also, a device for uniformly providing a suction force on a plane body on a support, the device being especially suitable for printing machines and their accessories, the device comprising a closed suction chamber having a supporting surface, the supporting surface featuring suction ports, a blower being assigned to the suction chamber and producing an underpressure in the suction chamber, and the device being designed so as to increase the suction capacity in the marginal area of the body to be sucked by using as little energy as possible.

20 Claims, 3 Drawing Sheets

PRINTING PRESS WITH A DEVICE FOR PROVIDING A SUCTION FORCE

BACKGROUND OF THE INVENTION

1. Field of the Invention

The present invention generally relates to a printing press, wherein such a printing press may include a device for uniformly sucking a plane body provided on a support. The device comprises a closed suction chamber, the supporting surface of which features suction ports, and a blower which is assigned to the suction chamber and produces an underpressure, or vacuum pressure, in the suction chamber.

Additionally, the present invention relates to a device for uniformly sucking a plane body provided on a support, especially for printing machines and their accessories, the device comprising a closed suction chamber, the supporting surface of which features suction ports, and a blower which is assigned to the suction chamber and produces an underpressure, or vacuum pressure in the suction chamber.

2. Summary of the Invention

Such a device may be used on a measuring table, or aligning table, for example, when providing a suction force on sheets. It may also be used on transport drums on the respective outer cylindrical surface of which, for example, printed paper sheets have a suction force applied thereto in order to be conveyed to a new processing station.

Known devices for providing a suction force on plane bodies that are provided on a respective support have the disadvantage that, in the marginal area of the body to be sucked, the vacuum pressure or underpressure of the suction air can drop considerably so that it cannot always be ensured that the marginal areas come to lie properly on the supporting surface of the device. Attempts have been made to avoid this phenomenon by increasing the suction capacity of the blower used and thus the underpressure within the suction chamber. As a result thereof, the production costs as well as the operating costs are also increased without ensuring that the plane and format-independent bodies, featuring a certain stiffness, such as printing plates, come to lie properly on a support, especially in view of the marginal areas.

Other systems solve this problem by increasing the energy or air consumption, or by switching the vacuum zones depending on the respective format used. The systems using vacuum zones tend to comprise an expensive vacuum pump which does not allow any leaking, as such leakage losses would cause the vacuum to collapse. Furthermore, such systems tend not to be very dynamic with respect to their suction behavior.

OBJECT OF THE INVENTION

Proceeding from the facts associated with the known arrangements discussed above, it is an object of the present invention to increase the suction capacity in the marginal area of the body to be sucked by essentially using as little energy as possible.

SUMMARY OF THE INVENTION

According to the present invention, the above object can be achieved, in accordance with at least one preferred embodiment, in that the support is, at least, of a two-layer design, that a lower throttle plate having suction porte maintains the underpressure in the suction chamber, that an upper supporting plate also having suction ports and bearing the plane body is provided at a smell distance with respect to the lower throttle plate, and that thin labyrinth-like intervals or passages are provided between both of the aforementioned plates in order to increase the flow resistance. The labyrinth-like intervals can essentially increase the flow resistance of the suction air in the marginal area or areas of the body to be sucked so that the reduction of the underpressure or vacuum force is lessened, thus providing a greater suction effect in the marginal area of the material to be sucked. Practical tests have shown that relatively stiff material such as, for example, flexible printing plates, can be sucked with respect to the marginal area so that only a relatively small housing, or chamber, is needed in order to cut down on energy consumption. The material to be sucked may essentially be of any format.

In an advantageous embodiment of the present invention, the labyrinth-like intervals can be provided in intermediate layers between the aforementioned throttle plate and supporting plate. In these thin intermediate layers, recesses forming the aforementioned intervals may be provided without essentially any problems.

An advantageous embodiment of the present invention is characterized in that a first intermediate layer features equally distributed bores, and that a second intermediate layer comprises suction chambers separated by skeletally arranged crosspieces and that the diameter of a respective bore of the first intermediate layer is greater than the width of a respective crosspiece of the second intermediate layer so that there is a connection between the suction spaces.

A further advantageous embodiment is characterized in that the crosspieces of the second intermediate layer comprise, i.e. surround, or define, square suction spaces and run in the middle of a row of bores of the first intermediate layer. Of course, in accordance with at least one preferred embodiment of the present invention, the aforementioned embodiments of the labyrinth-like intervals can be arbitrarily varied and modified with respect to their design, always with the aim to increase the flow resistance of the suction air without increasing the suction capacity.

Generally, it is to be understood that the term "marginal area(s)", as set forth herein, can be considered as being indicative of that area, or those areas, of a planar object which are located at or near the edges of the object.

The above discussed embodiments of the present invention will be described further hereinbelow with reference to the accompanying figures. When the word "invention" is used in this specification, the word "invention" includes "inventions" that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

In summary, one aspect of the invention resides broadly in a printing press comprising: at least one printing unit comprising: a frame; a plate cylinder being rotatably mounted on the frame; an inking unit for supplying ink to the plate cylinder; the inking unit comprising: an ink fountain for containing ink; a plurality of inking rollers; means for transferring ink between the ink fountain and the plurality of inking rollers; a plurality of ink applicator rollers for transferring ink between the plurality of inking rollers and the plate cylinder; a damping unit for supplying damping medium to the plate cylinder; a blanket cylinder having means for being engaged with the plate cylinder; means for feeding sheets, to be printed, to the at least one printing unit; means for directing printed sheets away from the at least one printing unit; means for providing a suction force, the means for providing a suction force comprising: means for supporting a body to be subjected to the suction force; means for generating suction; means, disposed through the supporting means, for permitting the application of a suction force, generated by the generating means, to a body supported on the supporting means; the means for permitting the application of a suction force comprising suction input means end suction output means, the suction input means for being disposed towards a body to be supported on the supporting means, the suction output means for being disposed away from a body to be supported on the supporting means; passage means, disposed in the supporting means, for providing fluid communication between the suction input means and the suction output means; and the passage means comprising means for directing a suction force, between the suction input means and the suction output means, in a manner to increase the suction force at marginal areas of the body being supported on the supporting means.

BRIEF DESCRIPTION OF THE DRAWINGS

Specimen embodiments of the present invention are schematically illustrated in the accompanying drawings, wherein.

DESCRIPTION OF THE PREFERRED EMBODIMENTS

Figure 1:
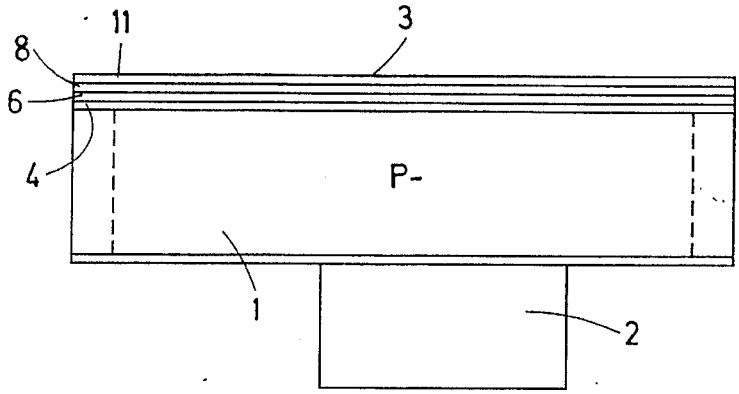
FIG. 1 is a side elevational view of a suction chamber.
Figure 1A:
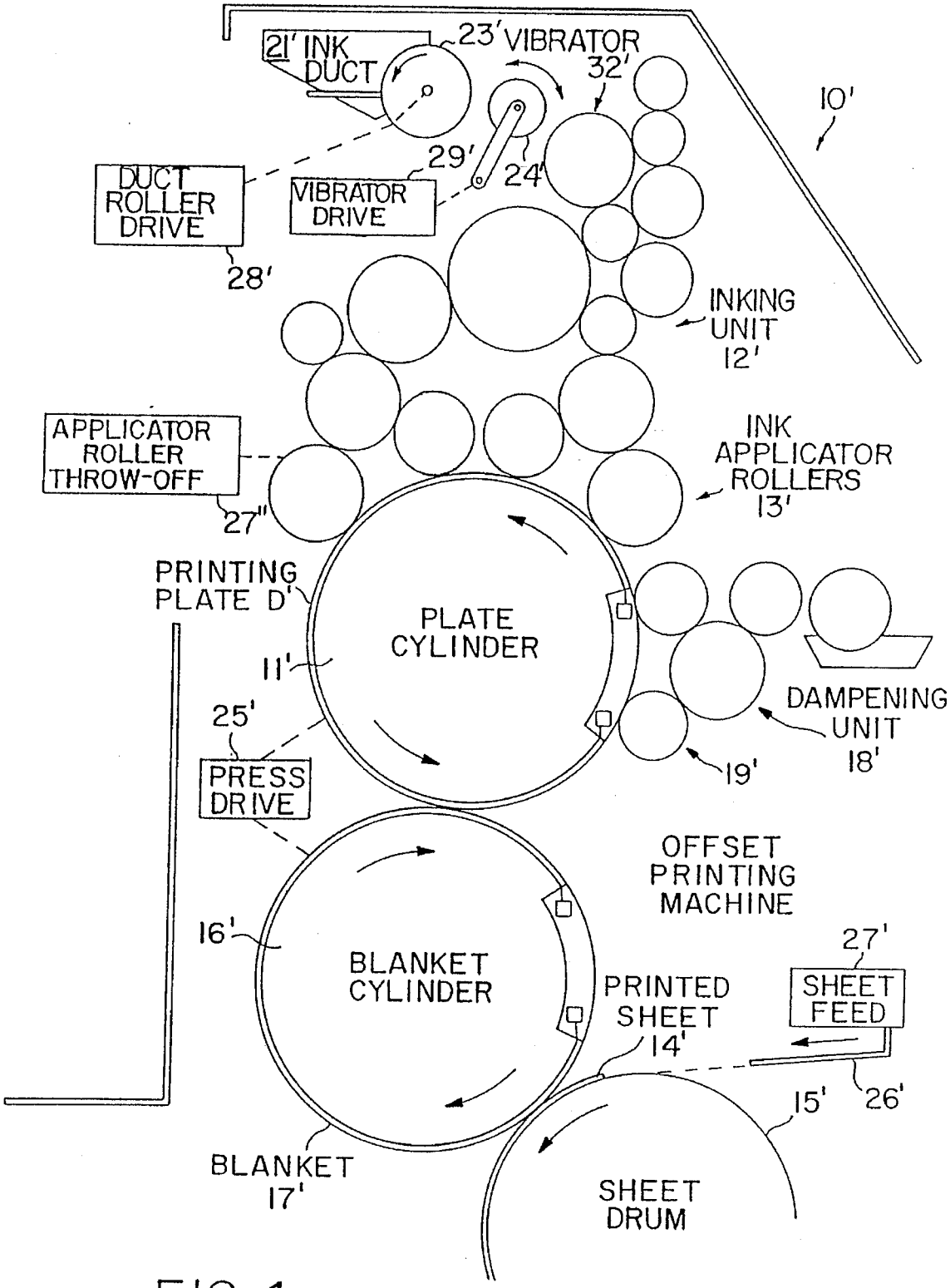
FIG. 1*a* illustrates a printing unit of a printing press in which the present invention may be employed.

FIG. 1*a* illustrates a rotary print stand 10' of a rotary printing press which can employ a suction arrangement according to the present invention. Rotary print stand 10' generally includes; a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' end deposit the same on a roller 32' of inking unit 10'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25' and a sheet feed 27' for supplying the sheets to be printed 26' to sheet drum 15'.

It should be understood that the components and methods discussed above with relation to FIG. 1*a* may, if appropriate, essentially be considered to be interchangeable with similar components and methods discussed herebelow with relation to FIGS. 1*b*–3.

Figure 1B:
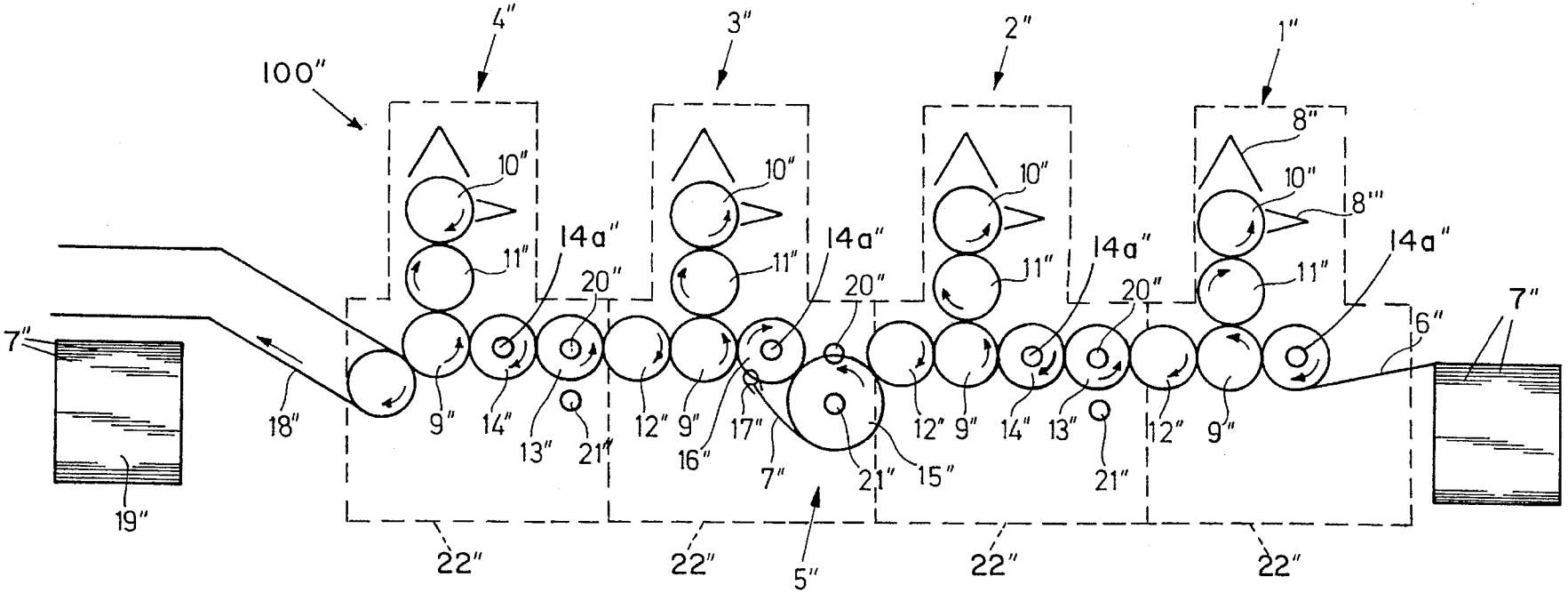
FIG. 1*b* illustrates a multi-stand printing press in which the present invention may be employed.

FIG. 1*b* schematically illustrates a multi-unit printing press 100" which may employ a suction arrangement according to the present invention. Particularly, a multi-unit printing press 100" may typically include a plurality of printing units, such as four printing units 1", 2", 3" and 4". Each printing unit may typically include a support frame arrangement 22".

The sheets 7" to be processed can preferably be fed from a supply stock to the impression cylinder 9" of a first printing unit 1" by sheet feeder 6". Each sheet 7" can preferably receive its first ink application by means of plate cylinder 10" and blanket cylinder 11" of printing unit 1". Accordingly, each subsequent printing unit 2", 3" and 4" can also typically include its own plate cylinder 10" and blanket cylinder 11". Typically, an inking unit 8" and damping unit 8'" can be assigned to each plate cylinder 10".

In accordance with at least one preferred embodiment of the present invention, there are preferably transfer rollers or drums 13" provided, and possibly also a transfer roller or drum 15".

A possible location of supporting surface 3, suction chamber 1 and blower 2 (to be described herebelow with relation to FIGS. 1–3), in accordance with at least one preferred embodiment of the present invention, is at the sheet delivery area of the printing press 100". Particularly, suction chamber 1, supporting surface 3 and blower 2 may form part of a sheet delivery apparatus, wherein at least portions of printed sheets borne by conveyor 18" would be drawn downward by suction onto supporting surface 3. The general operation and makeup of sheet delivery apparatus will be well-known to those of ordinary skill in the printing arts and, as such, will not be described further herein. However, further details regarding such sheet delivery apparatus may be found in any of several pertinent U.S. Patents listed at the close of the instant specification, including U.S. Pat. No. 5,259,608 to Pollich.

In accordance with at least one preferred embodiment of the present invention, supporting surface 3 may be utilized in conjunction with a transfer cylinder or drum, such as those indicated at 13" and 15" in FIG. 1*b*. The general operation and makeup of drums and cylinders with suction capacity will be well-known to those of ordinary skill in the printing arts and, as such, will not be described further herein. However, further details regarding such drums and cylinders may be found in any of several pertinent U.S. Patents listed at the close of the instant specification.

Other components illustrated in FIG. 1*b* but not otherwise described herein are discussed in U.S. Pat. No. 5,016,529 to Jahn, which is incorporated by reference herein.

In accordance with at least one preferred embodiment of the present invention, a supporting surface 3, suction chamber 1 and blower 2 may be utilized in either a lacquering station of a printing press or a drying station associated with such a lacquering station. In either context, at least a portion of supporting surface 3 could conceivably be essentially horizontal. The general operation end makeup of such lacquering end drying stations will be well-known to those of ordinary skill in the printing arts and, as such, will not be described further herein. However, further details regarding such lacquering and drying stations can be found in the following two publications, both published by Heidelberger Druckmaschinen Aktiengesselschaft (Heidelberg, Germany), which are hereby incorporated by reference into the instant specification: "Lackieren und Trotkhan", designated with the reference Heidelberger Nachrichten (HN) 3/49; and "Heidelberg M-Offset CP-Tronic", designated with the reference HN 1/49.

In accordance with at least one preferred embodiment of the present invention, a suction chamber 1, blower 2 and supporting surface 3, such as will be described hereinbelow, could be used in conjunction with the aligning, registration or measurement of flexible printing plates. They could also be used in conjunction with apparatus for transferring sheets between printing stations, in which case a planar surface could be provided, corresponding to supporting surface 3, for directing the sheets. Further details regarding components of this nature may be found in any of several pertinent U.S. Patents listed at the close of the instant specification.

FIG. 1 shows a closed suction chamber 1 in which an underpressure is produced by means of a blower 2. The suction chamber 1 preferably has a supporting surface 3 on which plane bodies may have a suction force applied thereto. The supporting surface 3 may be plane or may be of another configuration such as, for example, a vaulted or etched configuration.

Figure 2:
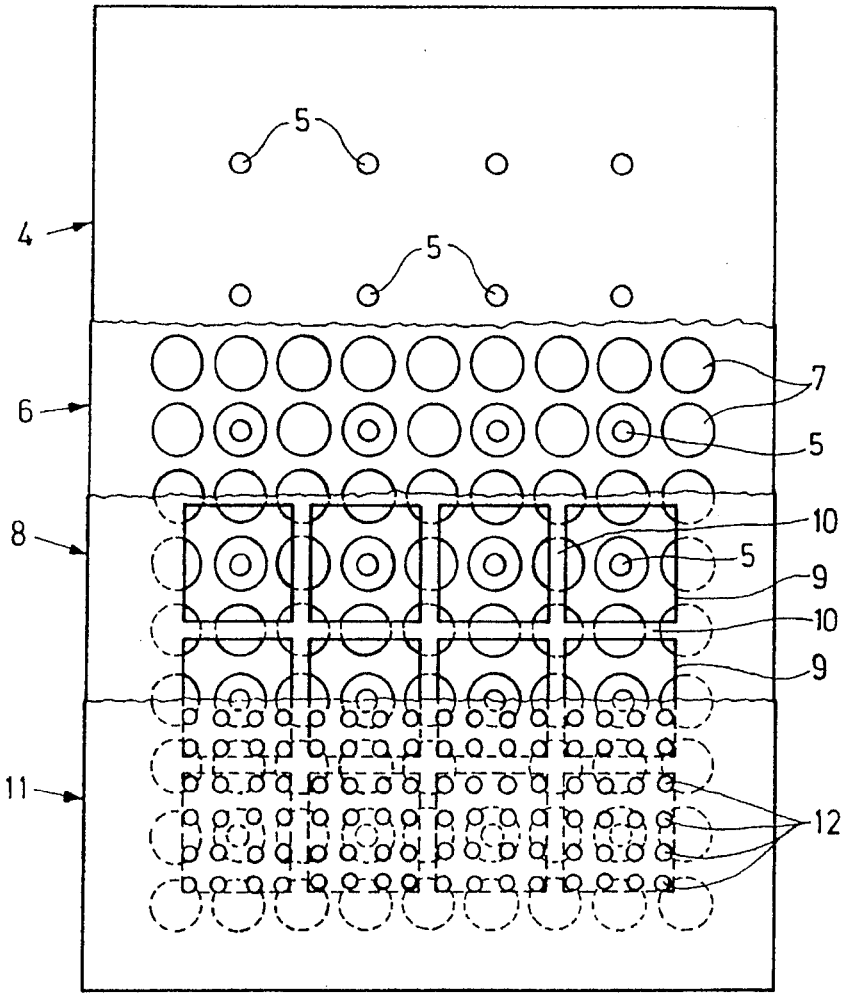
FIG. 2 is a top view of partial areas of the throttle plate, the supporting plate and the intermediate layers.

According to the present invention the supporting surface 3 preferably includes, first of all, a lower throttle plate 4 sealing the suction space of suction chamber 1, as shown in FIG. 2. The throttle plate 4 preferably features suction ports 5 for maintaining the underpressure in the suction chamber for a given blower capacity.

In the specimen embodiment shown, a first intermediate layer 6 is preferably provided above the throttle plate 4, and intermediate layer 6 preferably features bores 7. Preferably, the diameter of a respective bore 7 is greater than that of a respective suction port 5.

Upon this first intermediate layer 6, there is preferably provided a second intermediate layer 8 which features suction spaces 9 which are separated by crosspieces 10. In the specimen embodiment shown the suction spaces 9 are square-shaped, with the width of a respective crosspiece 10 being smaller than the diameter of a respective bore 7. It is advantageous to provide the crosspiece 10 so as to extend in the middle of a row of bores 7 of the first intermediate layer 6. This makes it possible for the suction air to pass through the bores 7 from a suction space 9 to an adjacent suction space 1 underneath the crosspiece 10.

In accordance with at least one preferred embodiment of the present invention, the aforementioned crosspieces 10 may be considered to be skeletally arranged. Preferably, crosspieces 10, as shown in FIG. 2, may essentially form a square or rectilinear grid, whereby suction spaces 9 are essentially surrounded by crosspieces 10.

A supporting plate 11, preferably featuring a plurality of small suction ports 12, is preferably provided as a direct support for the plane bodies to be sucked. On the supporting plate 11, flexible printing plates or printed sheet material, for example, may have a suction force applied thereto for the purpose of taking measurements or to be conveyed.

Figure 3:
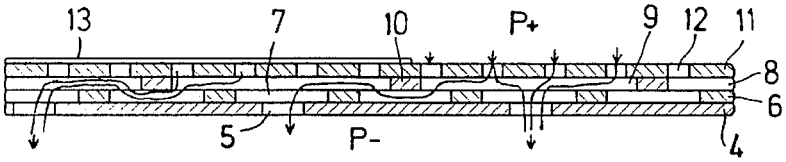
FIG. 3 is a partial cross-sectional view of the plates end the intermediate layers.

With respect to the partial cross-sectional view, shown in FIG. 3, of the throttle plate 4, the first intermediate layer 6, the second intermediate layer 8, and the supporting plate 11, it should be understood that there will be an underpressure P (shown as "P−") in the suction chamber 1 directly below the throttle plate 4, whereas above the supporting plate 1 there will essentially be an atmospheric pressure (shown as "P+").

Due to the labyrinth-like intervals 7, 9, the suction air applied to the body 13 may also be provided by means of suction ports 5 not lying in the marginal area of the body 13, i.e. by suction ports provided below said body 13, when sucking a plane body 13 on the supporting plate 11. In general, there will essentially be no suction-air flow below e body lying on a support, so that the suction ports 5 will essentially increase the suction effect in the marginal area of the body 13 and ensure that the respective body lies properly on the supporting plate 11.

In other words, in accordance with at least one preferred embodiment of the present invention, it will be appreciated that, when there is a plane body on supporting surface 3, the suction force provided on marginal areas of the plane body 13 can be provided not only by suction ports 5 lying essentially directly below the marginal areas of the plane body 13, but also by suction ports 5 not lying essentially directly below the marginal areas of the plane body 13 but below other areas of the plane body 13, such as central areas or other non-marginal areas. Essentially, in accordance with at least one preferred embodiment of the present invention, the suction force provided through a suction port 5 located below a non-marginal area of the plane body 13 can, with the assistance of the aforementioned labyrinth-like intervals/passages 7, 9, be used to supplement the suction force provided by suction ports 5 located below marginal areas of the plane body 13, thus helping ensure that an adequate suction force will be provided at the marginal areas of the plane body 13.

In accordance with at least one preferred embodiment of the present invention, the arrangement shown in FIG. 2 could be considered to schematically represent the surface of a suction drum or cylinder as mentioned heretofore, wherein the overall rectiliear layout shown would be analogous to the surface of the cylinder being "unrolled".

The general arrangement and dimensions of suction ports 5 and 12, as well as bores 7, suction spaces 9 and crosspieces 10, as illustrated in FIG. 2, is provided only as an example and is not meant to be restrictive. However, it may be considered that, in accordance with at least one preferred embodiment of the present invention, the following general layout can be provided:

- throttle plate 4 may be provided with equidistantly spaced suction ports 5, preferably arranged in rectilinear rows and columns, for example in a 4×6 grid as shown;
- intermediate layer 6, immediately above throttle plate 4, may be provided with equidistantly spaced bores 7, preferably arranged in rectilinear rows and columns, for example in a 9×13 grid as shown, wherein every second row of bores 7 may be superimposed on every row of suction ports 5 and every second column of bores 7 may be superimposed on every column of suction ports 5, such that the remaining rows end columns of bores 7 will not be superimposed over any suction ports 5, and whereby, in each of the rows and columns of bores 7 superimposed over the rows and columns of suction ports 5, there will preferably be one bore 7 directly and concentrically superimposed over each suction port 5;
- each of the suction ports 5 may preferably have the same diameter;
- each of the bores 7 may preferably have the same diameter;
- the diameter of each bore 7 may preferably be greater than the diameter of each suction port 5;
- intermediate layer 8, immediately above intermediate layer 6, may be provided with crosspieces 10 forming a rectilinear grid, such that contiguous crosspieces 10 may preferably define rectilinear, possibly square, suction spaces 9 therewithin, wherein each such suction space 9 may preferably be directly and concentrically superimposed over a bore 7 which itself is superimposed over a suction port 5, and wherein limited portions of the eight other bores 7 disposed about the central bore 7 in question will also be superimposed by the suction space 9 in question (i.e. each corner of the suction space 9 may be superimposed over a corresponding bore 7 such that a contiguous space is provided between the suction space 9 and each such corner bore 7, and each side of the suction space 9 may be superimposed over a corresponding bore 7 such that a contiguous space is provided between the suction space 9 and each such side bore 7);

supporting plate 11, immediately above intermediate layer 8, may be provided with equidistantly spaced suction ports 12, preferably arranged in rectilinear rows and columns, wherein sixteen such suction ports 12 may be uniformly superimposed over each suction space 9, such that four rows of four suction ports 12 may extend over suction space 9 side-to-side and that four columns of four suction ports 12 may extend over suction space 9 side-to-side, and such that at least a limited portion of each suction port 12 may be superimposed over a bore 7;

each suction port 12 will preferably not be superimposed, either directly or indirectly, over any suction port 5; and each suction port 12 will preferably have the same diameter, this diameter preferably being smaller then that of each suction port 5.

One feature of the invention resides broadly in the device for uniformly sucking a plane body on a support, especially suitable for printing machines and additional equipment, comprising a closed suction chamber having a supporting surface, said supporting surface featuring suction ports, and a blower assigned to said suction chamber and producing an underpressure in said suction chamber, characterized in that the support is, at least, of a two-layer design, that a lower throttle plate 4 features suction ports 5 maintaining the underpressure in said suction chamber 1, that an upper supporting plate 11 also featuring suction ports 12 and, at the same time, bearing the plane body 13 is provided at a small distance with respect to said lower throttle plate 4, and that than labyrinth-like intervals 7, 9 are provided between both plates 4, 11 in order to increase the flow resistance.

Another feature of the invention resides broadly in the device characterized in that the labyrinth-like intervals 7, 9 in intermediate layers 6, 8 are provided between throttle plate 4 and supporting plate 11.

Yet another feature of the invention resides broadly in the device characterized in that a first intermediate layer 6 features uniformly distributed bores 7, that a second intermediate layer 8 features suction chambers 9 separated by crosspieces 10, and that the diameter of a respective bore 7 of said first intermediate layer 6 is greater than the width of a respective crosspiece 10 of said second intermediate layer 8 so that there is a connection between the suction spaces 7, 9.

Still another feature of the invention resides broadly in the device characterized in that the crosspieces 10 of the second intermediate layer 8 define square-shaped suction spaces 9, and that each of said crosspieces extends in the middle of a row of bores 7 of said first intermediate layer 6.

In brief recapitulation, it will be appreciated from the disclosure heretofore that the present invention, in accordance with at least one preferred embodiment thereof, can generally relate to a device for uniformly providing a suction force on a plane body provided on a support, especially in printing machines or presses and their accessories.

Examples of vacuum conveyors or suction conveyors, involving perforated belts travelling over perforated suction boxes, which may be utilized in accordance with the embodiments of the present invention, may be found in the following U.S. patents: U.S. Pat. No. 5,348,285, which issued to Hüser on Sep. 20, 1994; U.S. Pat. No. 5,305,869, which issued to Damkjaer on Apr. 26, 1994; U.S. Pat. No. 4,824,092, which issued to Kriefall et al. on Apr. 25, 1989; and U.S. Pat. No. 4,723,488, which issued to Inouye et al. on Feb. 9, 1988.

Examples of rollers, drums or cylinders with suction capacity, which may be utilized in accordance with the embodiments of the present invention, may be found in the following U.S. patents: U.S. Pat. No. 5,241,907, which issued to Dorsam et al. on Sep. 7, 1993; U.S. Pat. No. 5,230,456, which issued to Germann et al. on Jul. 27, 1993; U.S. Pat. No. 5,226,870, which issued to Smith et al. on Jul. 13, 1993; and U.S. Pat. No. 5,176,611, which issued to VerMehren on Jan. 5, 1993.

Examples of vacuum tables and suction tables, i.e. tables or planar surfaces having perforations through which a suction is provided with respect to a body on the surface of the table, which may be utilized in accordance with the embodiments of the present invention, such as in a sheet feeding, sheet delivery or sheet transfer arrangement, may be found in the following U.S. patents: U.S. Pat. No. 5,326,200, which issued to Suzuki on Jul. 5, 1994; U.S. Pat. No. 5,323,821, which issued to Suzuki on Jun. 28, 1994; U.S. Pat. No. 5,277,093, which issued to Kinte on Jan. 11, 1994 U.S. Pat. No. 5,277,092, which issued to Kinta on Jan. 11, 1994; U.S. Pat. No. 4,768,763, which issued to Gerber on Sep. 6, 1988; U.S. Pat. No. 4,730,526, which issued to Pearl et al. on Mar. 15, 1988; U.S. Pat. No. 4,675,242, which issued to Hashimoto et al. on Jun. 23, 1987; U.S. Pat. No. 4,651,984, which issued to Emrich on Mar. 24, 1987; U.S. Pat. No. 4,646,911, which issued to Pearl et al. on Mar. 3, 1987; and U.S. Pat. No. 5,243,909, which issued to DeMoore et al. on Sep. 14, 1993.

Examples of suction rollers, vacuum arrangements, and means for adjusting suction, which may be utilized in accordance with the embodiments of the present invention, may be found in the following U.S. patents: U.S. Pat. No. 5,110,112, which issued to Henn et al. on May 5, 1992; U.S. Pat. No. 5,109,741, which issued to Fuchs on May 5, 1992; U.S. Pat. No. 4,728,092, which issued to Selak on Mar. 1, 1988; and U.S. Pat. No. 2,645,480, which issued to Long on Jul. 14, 1953.

U.S. Pat. No. 4,621,576, entitled "Sheet-Fed Rotary Printing Presses For Single-Side Printing Or First Form And Perfector Printing" dicsloses a sheet-fed rotary printing press including different transfer drums, storage drums and turning drums which are well-known to those skilled in the printing arts.

Examples of sheet feeding arrangements, which may be utilized in accordance with the embodiments of the present invention, may be found in the following U.S. patents: U.S. Pat. No. 5,102,117, which issued to Henn et al. on Apr. 7, 1992; and U.S. Pat. No. 5,096,179, which issued to Schmitt on Mar. 17, 1992.

Examples of sheet delivery arrangements, which may be utilized in accordance with the embodiments of the present invention, may be found in the following U.S. patents: U.S. Pat. No. 5,259,608, which issued to Pollich on Nov. 9, 1993;

U.S. Pat. No. 4,479,645, which issued to Pollich on Oct. 30, 1984; U.S. Pat. No. 4,083,556, which issued to Schilling et al. on Apr. 11, 1978; and U.S. Pat. No. 4,243,166, which issued to Vossen and Vossen on Jan. 6, 1981.

Examples of suction arrangements, which may be utilized in accordance with the embodiments of the present invention, may be found in the following U.S. patents: U.S. Pat. No. 4,830,355, which issued to Jeschke on May 16, 1989; and U.S. Pat. No. 4,083,556, which issued to Schilling et al. on Apr. 11, 1978.

Examples of arrangements for automatically mounting printing plates, aligning printing plates, ensuring proper registration of printing plates, which may be utilized in accordance with the embodiments of the present invention, may be found in the following U.S. patents: U.S. Pat. No. 4,833,985, which issued to Kojima et al. on May 30, 1989; U.S. Pat. No. 4,846,059, which issued to Brown on Jul. 11, 1989; U.S. Pat. No. 4,846,063, which issued to Brown on Jul. 11, 1989; and U.S. Pat. No. 4,872,407, which issued to Banks on Oct. 10, 1989.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 44 06 739.9, filed on Mar. 2, 1994, having inventor Francesco Esposito, and DE-OS P 44 06 739.9 and DE-PS P 44 06 739.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

LIST OF REFERENCE NUMERALS (FIGS. 1–3)

1 suction chamber
2 blower
3 supporting surface
4 throttle plate
5 suction port
6 intermediate layer
7 bore
8 intermediate layer
9 suction space
10 crosspiece
11 supporting plate
12 suction port
13 body

What is claimed is:

1. A printing press comprising:

at least one printing unit comprising:

a frame;

a plate cylinder being rotatably mounted on said frame;

an inking unit for supplying ink to said plate cylinder;

said inking unit comprising:

an ink fountain for containing ink;

a plurality of inking rollers;

means for transferring ink between said ink fountain and said plurality of inking rollers;

a plurality of ink applicator rollers for transferring ink between said plurality of inking rollers and said plate cylinder;

a damping unit for supplying damping medium to said plate cylinder;

a blanket cylinder having means for being engaged with said plate cylinder;

means for feeding planar bodies to said at least one printing unit;

means for providing a suction force, said means for providing a suction force comprising:

means for supporting a planar body to be subjected to a suction force, said supporting means being dimensioned to receive planar bodies thereupon;

said supporting means having a first side and a second side, said first and second sides being disposed opposite one another;

means for generating suction;

means, disposed through said supporting means, for permitting the application of a suction force, generated by said generating means, to a planar body supported on said supporting means;

said means for permitting the application of a suction force comprising suction input means and suction output means, said suction input means having means for applying a suction force directly onto a planar body supported on said supporting means, said suction output means being disposed adjacent said means for generating a suction and away from said suction input means;

said suction input means being disposed at said first side of said supporting means, said suction output means being disposed at said second side of said supporting means;

said first side of said supporting means having a central region and marginal regions disposed about said central region, said central region having means for accommodating at least a central portion of a planar body supported on said supporting means, said marginal regions having means for accommodating at least marginal portions of a planar body disposed on said supporting means;

passage means, disposed in said supporting means, for providing fluid communication between said suction input means and said suction output means;

said passage means being disposed between said suction input means end said suction output means and comprising means for directing a suction force between said suction input means and said suction output means; and said means for directing a suction force comprising means for increasing the suction force at said marginal regions of said first side of said supporting means.

2. The printing press according to claim 1, wherein said means for increasing the suction force at said marginal regions comprises means for increasing the suction force at said marginal regions upon a planar body being supported by said supporting means on said first side of said supporting means.

3. The printing press according to claim 2, wherein:

said supporting means comprises:
a first, structurally contiguous layer; and
a second, structurally contiguous layer;

said first layer and said second layer being spaced apart from one another;

said suction input means comprises a plurality of openings disposed in said first layer;

said suction output means comprises a plurality of openings disposed in said second layer;

said passage means being disposed between said first and second layers of said supporting means; and said passage means comprise means for providing fluid communication between said openings of said first layer and said openings of said second layer.

4. The printing press according to claim 3, wherein:

said passage means comprises means for providing fluid communication between ones of said openings of said first layer and ones of said openings of said second layer;

said means for providing fluid communication between ones of said openings of said first layer and ones of said openings of said second layer comprises said means for increasing the suction force at said marginal regions of said first side of said supporting means; and said means for increasing the suction force at said marginal regions comprising means for increasing flow resistance of said suction force between said ones of said openings of said first layer and said ones of said openings of said second layer.

5. The printing press according to claim 4, wherein said means for increasing flow resistance comprises means for providing indirect, interrupted fluid communication between said ones of said openings of said first layer and said ones of said openings of said second layer.

6. The printing press according to claim 5, wherein:

said first layer of said supporting means is a first outer layer;

said second layer of said supporting means is a second outer layer;

said passage means comprises:
a first, structurally contiguous intermediate layer; and
a second, structurally contiguous intermediate layer;

said first and second intermediate layers being disposed adjacent one another;

said first intermediate layer being disposed adjacent said first outer layer;

said second intermediate layer being disposed adjacent said second outer layer; and said means for providing fluid communication between ones of said openings of said first outer layer and ones of said openings of said second outer layer comprising means for providing fluid communication through said first and second intermediate layers.

7. The printing press according to claim 6, wherein:

said means for increasing the suction force at marginal regions of said first side of said supporting means comprises a plurality of suction regions disposed in said first intermediate layer;

said second intermediate layer comprises a plurality of openings;

each of said plurality of openings of said second intermediate layer being disposed adjacent said plurality of suction regions, so as to provide fluid communication between said openings of said second intermediate layer and said plurality of suction regions;

said openings of said first outer layer being disposed adjacent said plurality of suction regions of said first intermediate layer, so as to provide fluid communication between said plurality of suction regions and said openings of said first outer layer; and said openings of said second outer layer being disposed adjacent said openings of said second intermediate layer, so as to provide fluid communication between said openings of said second outer layer and said openings of said second intermediate layer.

8. The printing press according to claim 7, wherein:

said first intermediate layer comprises a plurality of crosspieces separating said suction regions from one another; and ones of said openings of said second intermediate layer being disposed to straddle corresponding ones of said crosspieces, so as to provide fluid communication between adjacent ones of said suction regions through said ones of said openings of said second intermediate layer.

9. The printing press according to claim 8, wherein:

each of said openings of said second intermediate layer has a diameter;

each of said crosspieces of said first intermediate layer has a width; and each of said ones of said openings of said second intermediate layer, being disposed to straddle corresponding ones of said crosspieces, has a diameter greater than the width of the corresponding straddled crosspiece, so as to permit fluid communication between adjacent ones of said suction regions.

10. The printing press according to claim 9, wherein:

said openings of said second intermediate layer are uniformly distributed in a linear array in said second intermediate layer, said linear array comprising a plurality of rectilinear rows and columns of said openings of said second intermediate layer; and each of said crosspieces of said first intermediate layer being oriented parallel with respect to said rows end columns of said openings of said first intermediate layer.

11. The printing press according to claim 10, wherein:

said means for generating a suction comprises a closed suction chamber and a blower for generating suction, said blower being in fluid communication with said closed suction chamber so as to maintain a vacuum pressure in said closed suction chamber;

said supporting means having a thickness dimension defined through said first outer layer, said first intermediate layer, said second intermediate layer and said second outer layer;

said supporting means having at least one horizontal linear dimension defined perpendicular to the thickness dimension of said supporting means;

said first and second outer layers being separated from one another at a distance significantly smaller than the at least one horizontal linear dimension of said supporting means;

said suction regions of said first intermediate layer comprising square-like suction regions separated by said crosspieces;

said openings of said second intermediate layer comprise circular holes;

said openings of said first outer layer comprise circular holes;

said openings of said second outer layer comprise circular holes;

each of said holes of said second outer layer being disposed adjacent, and in fluid communication with, a corresponding one of said holes of said second intermediate layer;

each of said holes of said second intermediate layer having a diameter being considerably greater than the diameter of each of said circular holes of said second outer layer;

ones of said holes of said second intermediate layer being simultaneously in direct fluid communication with both of:

a corresponding one of said holes of said second outer layer; and a sole corresponding one of said square-like suction regions of said first intermediate layer;

ones of said holes of said second intermediate layer being disposed to straddle corresponding ones of said crosspieces, so as to be simultaneously in fluid communication with two of said square-like suction regions;

said first intermediate layer comprises a plurality of intersection regions, at which intersection regions four of said crosspieces intersect in a perpendicular manner;

ones of said holes of said second intermediate layer being disposed to straddle corresponding ones of said intersection regions, so as to be simultaneously in fluid communication with four of said square-like suction regions;

said openings of said first outer layer comprise a plurality of circular holes;

each of said circular holes of said first outer layer being in direct, uninterrupted, superimposed fluid communication with one of said square-like suction regions;

said square-like suction regions are in direct, uninterrupted fluid communication with sixteen of said circular holes of said first outer layer;

each of said square-like suction regions is at least partly superimposed with respect to nine of said circular holes of said second intermediate layer, such that one of said circular holes of said second intermediate layer is directly and centrally superimposed with respect to a corresponding one of said square-like suction regions; and each of said circular holes of said second intermediate layer has a diameter greater than the diameter of each of said circular holes of said first outer layer.

12. The printing press according to claim 11, wherein said means for feeding planar bodies to said at least one printing unit comprises a suction table for aligning printing plates, said suction table comprising said means for providing a suction force, said supporting means being dimensioned to receive printing plates thereupon.

13. The printing press according to claim 11, further comprising a sheet transfer drum for directing printed sheets away from said at least one printing unit, said sheet transfer drum comprising said means for providing a suction force, said sheet transfer drum having an outer cylindrical surface, said outer cylindrical surface of said transfer drum comprising said first side of said supporting means, said second side of said supporting means being disposed radially inwardly with respect to said first side.

14. The printing press according to claim 11, wherein said means for directing printed sheets away from said at least one printing unit comprises a sheet delivery table, said sheet delivery table comprising said means for providing a suction force, said first side of said supporting means comprising a flat, planar surface of said sheet delivery table.

15. In a printing press comprising: at least one printing unit comprising: a frame; a plate cylinder being rotatably mounted on said frame; an inking unit for supplying ink to said plate cylinder; said inking unit comprising: an ink fountain for containing ink, a plurality of inking rollers, means for transferring ink between said ink fountain and said plurality of inking rollers, and a plurality of ink applicator rollers for transferring ink between said plurality of inking rollers and said plate cylinder; a damping unit for supplying damping medium to said plate cylinder; a blanket cylinder having means for being engaged with said plate cylinder; and means for feeding planar bodies to said at least one printing unit;

means for providing a suction force, said means for providing a suction force comprising:

means for supporting a planar body to be subjected to a suction force, said supporting means being dimensioned to receive planar bodies thereupon;

said supporting means having a first side and a second side, said first and second sides being disposed opposite one another;

means for generating suction;

means, disposed through said supporting means, for permitting the application of a suction force, generated by said generating means, to a planar body supported on said supporting means;

said means for permitting the application of a suction force comprising suction input means and suction output means, said suction input means having means for applying a suction force directly onto a planar body supported on said supporting means, said suction output means being disposed adjacent said means for generating a suction and away from said suction input means;

said suction input means being disposed at said first side of said supporting means, said suction output means being disposed at said second side of said supporting means;

said first side of said supporting means having a central region and marginal regions disposed about said central region, said central region having means for accommodating at least a central portion of a planar body supported on said supporting means, said marginal regions having means for accommodating at least marginal portions of a planar body disposed on said supporting means;

passage means, disposed in said supporting means, for providing fluid communication between said suction input means and said suction output means;

said passage means being disposed between said suction input means and said suction output means and comprising means for directing a suction force between said suction input means and said suction output means; and said means for directing a suction force comprising means for increasing the suction force at said marginal regions of said first side of said supporting means.

16. In a printing press according to claim 15, wherein said means for increasing the suction force at said marginal regions comprises means for increasing the suction force at said marginal regions upon a planar body being supported by said supporting means on said first side of said supporting means.

17. In a printing press according to claim 16, wherein:

said supporting means comprises:
a first, structurally contiguous layer; and
a second, structurally contiguous layer;

said first layer and said second layer being spaced apart from one another;

said suction input means comprises a plurality of openings disposed in said first layer;

said suction output means comprises a plurality of openings disposed in said second layer;

said passage means being disposed between said first and second layers of said supporting means;

said passage means comprise means for providing fluid communication between said openings of said first layer and said openings of said second layer;

said passage means comprises means for providing fluid communication between ones of said openings of said first layer and ones of said openings of said second layer;

said means for providing fluid communication between ones of said openings of said first layer and ones of said openings of said second layer comprises said means for increasing the suction force at said marginal regions of said first side of said supporting means;

said means for increasing the suction force at said marginal regions comprising means for increasing flow resistance of said suction force between said ones of said openings of said first layer and said ones of said openings of said second layer;

said means for increasing flow resistance comprises means for providing indirect, interrupted fluid communication between said ones of said openings of said first layer and said ones of said openings of said second layer;

said first layer of said supporting means is a first outer layer;

said second layer of said supporting means is a second outer layer;

said passage means comprises,
a first, structurally contiguous intermediate layer; and
a second, structurally contiguous intermediate layer;

said first and second intermediate layers being disposed adjacent one another;

said first intermediate layer being disposed adjacent said first outer layer;

said second intermediate layer being disposed adjacent said second outer layer;

said means for providing fluid communication between ones of said openings of said first outer layer and ones of said openings of said second outer layer comprising means for providing fluid communication through said first and second intermediate layers;

said means for increasing the suction force at marginal regions of said first side of said supporting means comprises a plurality of suction regions disposed in said first intermediate layer;

said second intermediate layer comprises a plurality of openings;

each of said plurality of openings of said second intermediate layer being disposed adjacent said plurality of suction regions, so as to provide fluid communication between said openings of said second intermediate layer and said plurality of suction regions;

said openings of said first outer layer being disposed adjacent said plurality of suction regions of said first intermediate layer, so as to provide fluid communication between said plurality of suction regions and said openings of said first outer layer;

said openings of said second outer layer being disposed adjacent said openings of said second intermediate layer, so as to provide fluid communication between said openings of said second outer layer and said openings of said second intermediate layer;

said first intermediate layer comprises a plurality of crosspieces separating said suction regions from one another; and ones of said openings of said second intermediate layer being disposed to straddle corresponding ones of said crosspieces, so as to provide fluid communication between adjacent ones of said suction regions through said ones of said openings of said second intermediate layer;

each of said openings of said second intermediate layer has a diameter;

each of said crosspieces of said first intermediate layer has a width; and each of said ones of said openings of said second intermediate layer, being disposed to straddle corresponding ones of said crosspieces, has a diameter greater than the width of the corresponding straddled crosspiece, so as to permit fluid communication between adjacent ones of said suction regions;

said openings of said second intermediate layer are uniformly distributed in a linear array in said second intermediate layer, said linear array comprising a plurality of rectilinear rows and columns of said openings of said second intermediate layer;

each of said crosspieces of said first intermediate layer being oriented parallel with respect to said rows and columns of said openings of said first intermediate layer;

said means for generating a suction comprises a closed suction chamber and e blower for generating suction, said blower being in fluid communication with said closed suction chamber so as to maintain a vacuum pressure in said closed suction chamber;

said supporting means having a thickness dimension defined through said first outer layer, said first intermediate layer, said second intermediate layer and said second outer layer;

said supporting means having at least one horizontal linear dimension defined perpendicular to the thickness dimension of said supporting means;

said first and second outer layers being separated from one another at a distance significantly smaller than the at least one horizontal linear dimension of said supporting means;

said suction regions of said first intermediate layer comprising square-like suction regions separated by said crosspieces;

said openings of said second intermediate layer comprise circular holes;

said openings of said first outer layer comprise circular holes;

said openings of said second outer layer comprise circular holes;

each of said holes of said second outer layer being disposed adjacent, and in fluid communication with, a corresponding one of said holes of said second intermediate layer;

each of said holes of said second intermediate layer having a diameter being considerably greater than the diameter of each of said circular holes of said second outer layer;

ones of said holes of said second intermediate layer being simultaneously in direct fluid communication with both of:

a corresponding one of said holes of said second outer layer; and a sole corresponding one of said equate-like suction regions of said first intermediate layer;

ones of said holes of said second intermediate layer being disposed to straddle corresponding ones of said crosspieces, so as to be simultaneously in fluid communication with two of said square-like suction regions;

said first intermediate layer comprises a plurality of intersection regions, at which intersection regions four of said crosspieces intersect in a perpendicular manner;

ones of said holes of said second intermediate layer being disposed to straddle corresponding ones of said intersection regions, so as to be simultaneously in fluid communication with four of said square-like suction regions;

said openings of said first outer layer comprise a plurality of circular holes;

each of said circular holes of said first outer layer being in direct, uninterrupted, superimposed fluid communication with one of said square-like suction regions;

said square-like suction regions are in direct, uninterrupted fluid communication with sixteen of said circular holes of said first outer layer;

each of said square-like suction regions is at least partly superimposed with respect to nine of said circular holes of said second intermediate layer, such that one of said circular holes of said second intermediate layer is directly and centrally superimposed with respect to a corresponding one of said square-like suction regions; and each of said circular holes of said second intermediate layer has a diameter greater than the diameter of each of said circular holes of said first outer layer.

18. The printing press according to claim 17, wherein said means for feeding planar bodies to said at least one printing unit comprises a suction table for aligning printing plates, said suction table comprising said means for providing a suction force, said supporting means being dimensioned to receive printing plates thereupon.

19. Method of operating a printing press, such a printing press comprising: at least one printing unit comprising: a frame; a plate cylinder being rotatably mounted on the frame; an inking unit for supplying ink to the plate cylinder; the inking unit comprising: an ink fountain for containing ink, a plurality of inking rollers, means for transferring ink between the ink fountain and the plurality of inking rollers, and a plurality of ink applicator rollers for transferring ink between the plurality of inking rollers and the plate cylinder; a damping unit for supplying damping medium to the plate cylinder; a blanket cylinder having means for being engaged with the plate cylinder; and means for feeding planar bodies to the at least one printing unit; said method comprising the steps of:

providing means for providing a suction force;

said step of providing means for providing a suction force comprising:

providing means for supporting a planar body to be subjected to a suction force, the supporting means being dimensioned to receive planar bodies thereupon;

configuring the supporting means to have a first side and a second side, the first and second sides being disposed opposite one another;

providing means for generating suction;

providing means, disposed through the supporting means, for permitting the application of a suction force, generated by the generating means, to a planar body supported on the supporting means;

configuring the means for permitting the application of a suction force to comprise suction input means and suction output means, the suction input means having means for applying a suction force directly onto a planar body supported on the supporting means, the suction output means being disposed adjacent the means for generating a suction and away from the suction input means;

disposing the suction input means at the first side of the supporting means;

disposing the suction output means at the second side of the supporting means;

configuring the first side of the supporting means to have a central region and marginal regions disposed about the central region, the central region having means for accommodating at least a central portion of e planar body supported on the supporting means, the marginal regions having means for accommodating at least marginal portions of a planar body disposed on the supporting means;

providing passage means, disposed in the supporting means, for providing fluid communication between the suction input means and the suction output means, the passage means being disposed between the suction input means and the suction output means and comprising means for directing a suction force between the suction input means and the suction output means; and configuring the means for directing a suction force to comprise means for increasing the suction force at the marginal regions of the first side of the supporting means; said method further comprising the additional steps of: supporting a planar body on the supporting means and:

accommodating at least a central portion of the planar body on the central region of the first side of the supporting means; and accommodating at least marginal portions of the planar body on the marginal portions of the first side of the supporting means;

generating suction with the suction generating means;

applying a suction force, generated by the suction generating means, to the planar body supported on the supporting means;

said step of applying a suction force comprising the steps of:

applying a suction force directly onto the planar body with the suction input means;

directing the suction force between the suction input means and the suction output means with the means for directing a suction force; and with the means for directing a suction force, increasing the suction force at the marginal regions of the first side of the supporting means.

20. The method according to claim 19, further comprising the step of configuring the means for providing a suction force such that:

the means for increasing the suction force at the marginal regions comprises means for increasing the suction force at the marginal regions upon a planar body being supported by the supporting means on the first side of the supporting means;

the supporting means comprises:

a first, structurally contiguous layer; and a second, structurally contiguous layer;

the first layer and the second layer being spaced apart from one another;

the suction input means comprises a plurality of openings disposed in the first layer;

the suction output means comprises a plurality of openings disposed in the second layer;

the passage means being disposed between the first and second layers of the supporting means;

the passage means comprise means for providing fluid communication between the openings of the first layer and the openings of the second layer;

the passage means comprises means for providing fluid communication between ones of the openings of the first layer and ones of the openings of the second layer;

the means for providing fluid communication between ones of the openings of the first layer and ones of the openings of the second layer comprises the means for increasing the suction force at the marginal regions of the first side of the supporting means;

the means for increasing the suction force at the marginal regions comprising means for increasing flow resistance of the suction force between the ones of the openings of the first layer and the ones of the openings of the second layer;

the means for increasing flow resistance comprises means for providing indirect, interrupted fluid communication between the ones of the openings of the first layer and the ones of the openings of the second layer;

the first layer of the supporting means is a first outer layer;

the second layer of the supporting means is a second outer layer;

the passage means comprises:

a first, structurally contiguous intermediate layer; and a second, structurally contiguous intermediate layer;

the first and second intermediate layers being disposed adjacent one another;

the first intermediate layer being disposed adjacent the first outer layer;

the second intermediate layer being disposed adjacent the second outer layer;

the means for providing fluid communication between ones of the openings of the first outer layer and once of the openings of the second outer layer comprising means for providing fluid communication through the first and second intermediate layers;

the means for increasing the suction force at marginal regions of the first side of the supporting means comprises a plurality of suction regions disposed in the first intermediate layer;

the second intermediate layer comprises a plurality of openings;

each of the plurality of openings of the second intermediate layer being disposed adjacent the plurality of suction regions, so as to provide fluid communication between the openings of the second intermediate layer and the plurality of suction regions;

the openings of the first outer layer being disposed adjacent the plurality of suction regions of the first intermediate layer, so as to provide fluid communication between the plurality of suction regions and the openings of the first outer layer;

the openings of the second outer layer being disposed adjacent the openings of the second intermediate layer, so as to provide fluid communication between the openings of the second outer layer and the openings of the second intermediate layer;

the first intermediate layer comprises a plurality of crosspieces separating the suction regions from one another; and ones of the openings of the second intermediate layer being disposed to straddle corresponding ones of the crosspieces, so as to provide fluid communication between adjacent ones of the suction regions through the ones of the openings of the second intermediate layer;

each of the openings of the second intermediate layer has a diameter;

each of the crosspieces of the first intermediate layer has a width; and each of the ones of the openings of the second intermediate layer, being disposed to straddle corresponding ones of the crosspieces, has a diameter greater than the width of the corresponding straddled crosspiece, so as to permit fluid communication between adjacent ones of the suction regions;

the openings of the second intermediate layer are uniformly distributed in a linear array in the second intermediate layer, the linear array comprising a plurality of rectilinear rows and columns of the openings of the second intermediate layer;

each of the crosspieces of the first intermediate layer being oriented parallel with respect to the rows and columns of the openings of the first intermediate layer;

the means for generating a suction comprises a closed suction chamber and a blower for generating suction, the blower being in fluid communication with the closed suction chamber so as to maintain a vacuum pressure in the closed suction chamber;

the supporting means having a thickness dimension defined through the first outer layer, the first intermediate layer, the second intermediate layer and the second outer layer;

the supporting means having at least one horizontal linear dimension defined perpendicular to the thickness dimension of the supporting means;

the first and second outer layers being separated from one another at a distance significantly smaller than the at least one horizontal linear dimension of the supporting means;

the suction regions of the first intermediate layer comprising square-like suction regions separated by the crosspieces;

the openings of the second intermediate layer comprise circular holes;

the openings of the first outer layer comprise circular holes;

the openings of the second outer layer comprise circular holes;

each of the holes of the second outer layer being disposed adjacent, and in fluid communication with, a corresponding one of the holes of the second intermediate layer;

each of the holes of the second intermediate layer having a diameter being considerably greater than the diameter of each of the circular holes of the second outer layer;

ones of the holes of the second intermediate layer being simultaneously in direct fluid communication with both of:

a corresponding one of the holes of the second outer layer; and a sole corresponding one of the square-like suction regions of the first intermediate layer;

ones of the holes of the second intermediate layer being disposed to straddle corresponding ones of the crosspieces, so as to be simultaneously in fluid communication with two of the square-like suction regions;

the first intermediate layer comprises a plurality of intersection regions, at which intersection regions four of the crosspieces intersect in a perpendicular manner;

ones of the holes of the second intermediate layer being disposed to straddle corresponding ones of the intersection regions, so as to be simultaneously in fluid communication with four of the square-like suction regions;

the openings of the first outer layer comprise a plurality of circular holes;

each of the circular holes of the first outer layer being in direct, uninterrupted, superimposed fluid communication with one of the square-like suction regions;

the square-like suction regions are in direct, uninterrupted fluid communication with sixteen of the circular holes of the first outer layer;

each of the square-like suction regions is at least partly superimposed with respect to nine of the circular holes of the second intermediate layer, such that one of the circular holes of the second intermediate layer is directly and centrally superimposed with respect to a corresponding one of the square-like suction regions; and each of the circular holes of the second intermediate layer has a diameter greater than the diameter of each of the circular holes of the first outer layer.

* * * * *

UNITED STATES PATENT AND TRADEMARK OFFICE

CERTIFICATE OF CORRECTION

PATENT NO. : 5,505,124

DATED : April 9, 1996

INVENTOR(S) : Francesco ESPOSITO

It is certified that error appears in the above-indentified patent and that said Letters Patent is hereby corrected as shown below:

In column 3, line 12, after 'means' delete "end" and insert --and--.

In column 3, line 38, after 'plates' delete "end" and insert --and--.

In column 5, line 3, after 'und' delete "Trotkhan" and insert --Trocknen--.

In column 5, line 23, after 'or' delete "etched" and insert --arched--.

In column 6, line 7, before 'body' delete "e" and insert --a--.

In column 8, line 33, after 'to' delete "Kinte" and insert --Kinta--.

In column 10, line 59, Claim 1, after the first occurrence of 'means' delete "end" and insert --and--.

In column 12, line 44, Claim 10, after 'rows' delete "end" and insert --and--.

UNITED STATES PATENT AND TRADEMARK OFFICE

CERTIFICATE OF CORRECTION

PATENT NO. : 5,505,124

DATED : April 9, 1996

INVENTOR(S) : Francesco ESPOSITO

It is certified that error appears in the above-indentified patent and that said Letters Patent is hereby corrected as shown below:

In column 16, line 45, Claim 17, after 'and' delete "e" and insert --a--.

In column 17, line 18, Claim 17, after 'said' delete "equate-like" and insert --square-like--.

In column 18, line 37, Claim 19, after 'of' delete "e" and insert --a--.

Col. 19, line 66, Claim 20, after 'and' delete "once" and insert --ones--.

Signed and Sealed this

Third Day of December, 1996

Bruce Lehman

*Attest:*

BRUCE LEHMAN

*Attesting Officer*

*Commissioner of Patents and Trademarks*